US005509403A

United States Patent [19]

Kahlke et al.

[11] Patent Number: 5,509,403

[45] Date of Patent: Apr. 23, 1996

[54] GAS FIRES COOKING ASSEMBLY WITH PLATE CONDUCTIVE TO HEAT RADIATION

[75] Inventors: Michael Kahlke, Mainz; Kurt Schaupert, Hofheim, both of Germany

[73] Assignee: Schott Glaswerke, Mainz, Germany

[21] Appl. No.: 288,303

[22] Filed: Aug. 10, 1994

[30] Foreign Application Priority Data

Aug. 11, 1993 [DE] Germany ..... 43 26 945.1

[51] Int. Cl.[6] ..... F24C 3/00

[52] U.S. Cl. ..... 126/39 E; 126/39 J; 126/39 A; 126/39 K; 431/285; 431/165

[58] Field of Search ..... 126/39 E, 39 J, 126/39 A, 39 K; 431/285, 351, 352, 165

[56] References Cited

U.S. PATENT DOCUMENTS

| | | | |
|---|---|---|---|
| 3,468,298 | 9/1969 | Teague, Jr. et al. | 126/39 J |
| 4,020,821 | 5/1977 | Reid, Jr. et al. | 126/39 E |
| 4,083,355 | 4/1978 | Schwank | 126/39 J |
| 4,201,184 | 5/1980 | Scheidler et al. | 126/39 J |
| 4,580,550 | 4/1986 | Kristen et al. | 126/39 J |
| 4,673,349 | 6/1987 | Abe et al. | 431/328 |
| 4,951,646 | 8/1990 | Diekmann et al. | 126/39 J |
| 5,295,476 | 3/1994 | Herbert | 126/39 JX |

FOREIGN PATENT DOCUMENTS

| | | |
|---|---|---|
| 2585452 | 1/1987 | France . |
| 3934562 | 11/1990 | Germany . |
| 175962 | 10/1922 | United Kingdom . |
| 2230595 | 10/1990 | United Kingdom . |
| WO 84/01992 | 5/1984 | WIPO . |

OTHER PUBLICATIONS

"DIN EN 30 hushalt–Kochgeräte für gasförmige Brennstoffe", DIN Deutsches Institut für Normung E.V., Beuth Verlag GmbH, Berlin–Köln, Dec. 1979.

"Flameless Gas Burner", Global Environmental Solutions, California. (No date).

*Primary Examiner*—Larry Jones

*Attorney, Agent, or Firm*—Walter Ottesen

[57] ABSTRACT

The gas cooking assembly of the invention includes at least one gas-fired burner which has a burner chamber and a burner plate, especially a burner plate made of fiber material, the gas-fired burner being arranged below a continuous cooking plate made of a material conductive to heat radiation such as a glass ceramic, glass, ceramic or the like material. Control units are provided for metering gas as well as conventional ignition units, safety units and temperature-monitoring units. Exhaust-gas channels conduct away combustion gases. A blower brings additional air to the burner plate. The blower and control unit are located in a partitioned-off space wherein an overpressure is maintained by the blower. The partitioned-off space is connected via pipes to the burner chamber and to the ambient. The pipes are gas tight at their peripheral surfaces in the region outside of said partitioned-off space.

14 Claims, 6 Drawing Sheets

FIG. 1a
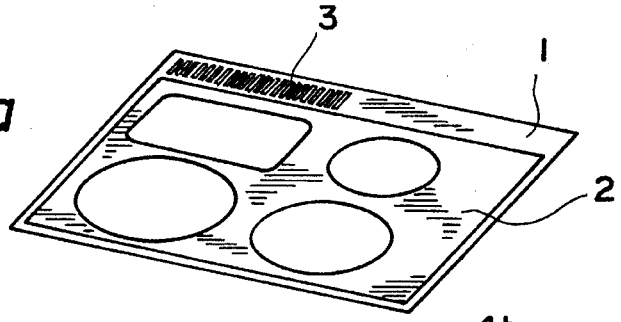
FIG. 1b
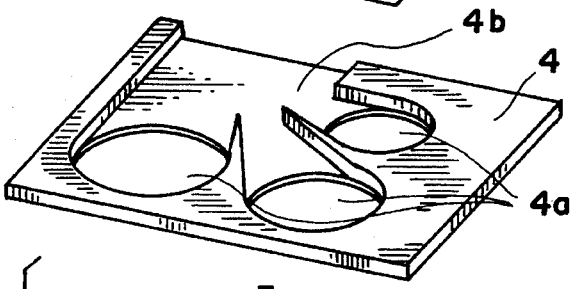
FIG. 1c
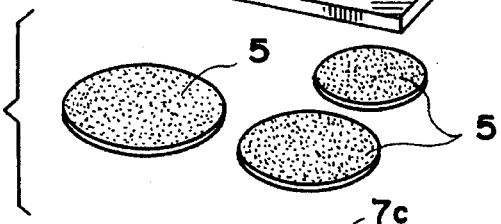
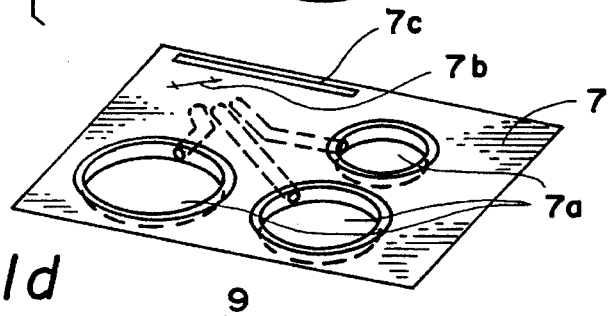
FIG. 1d
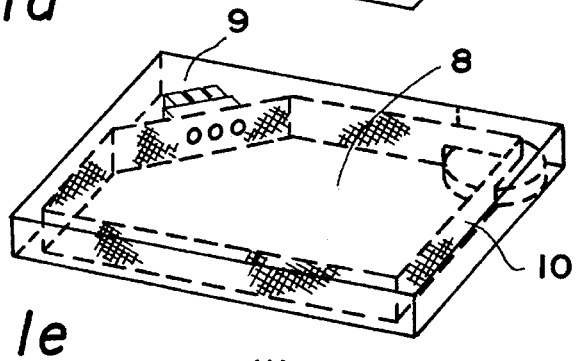
FIG. 1e
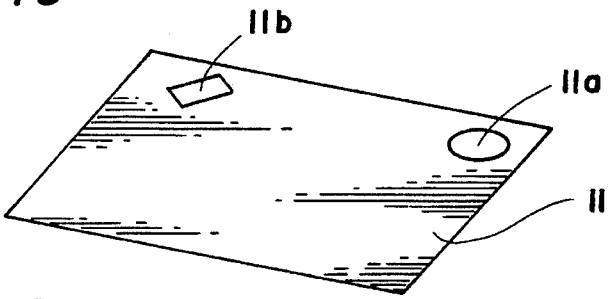
FIG. 1f FIG. 2a
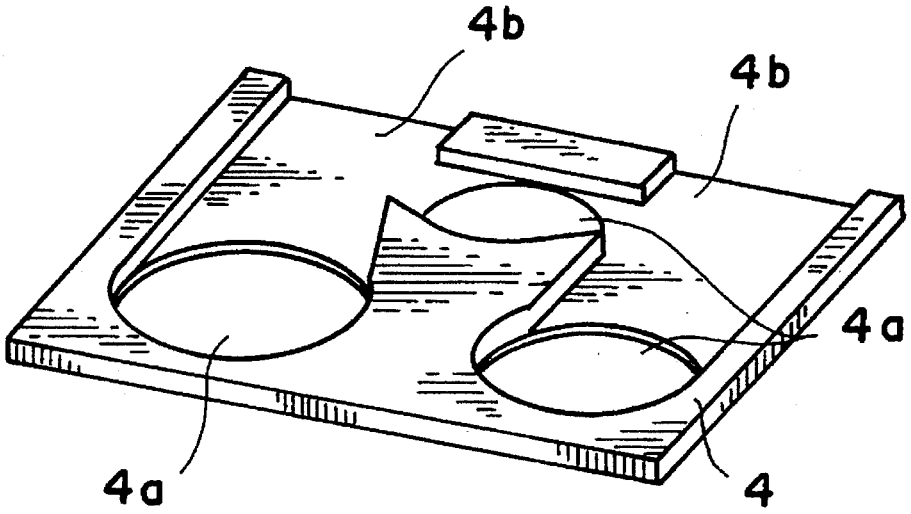
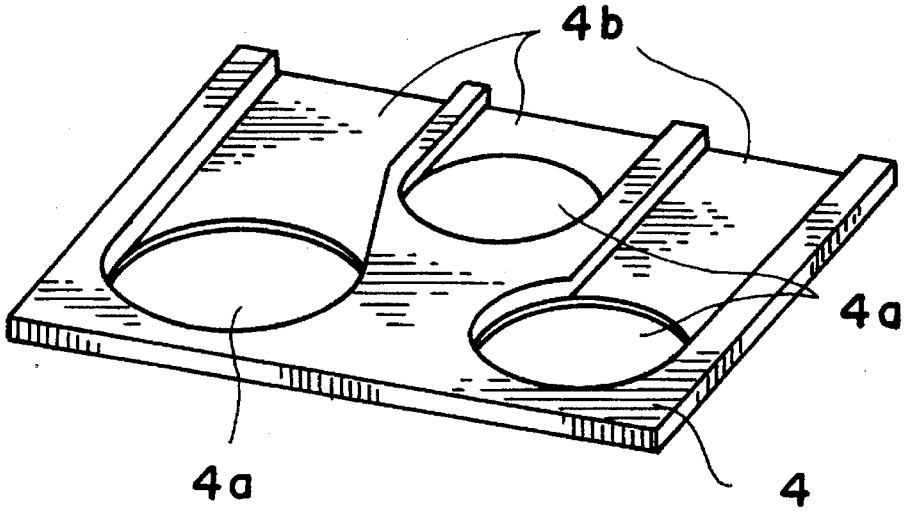
FIG. 2b FIG. 3a
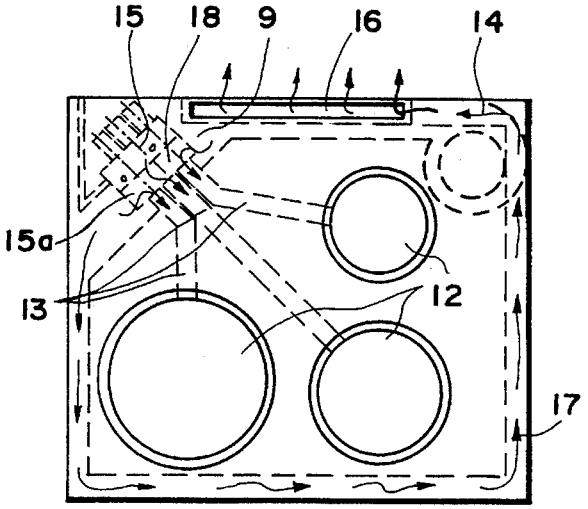
FIG. 3c
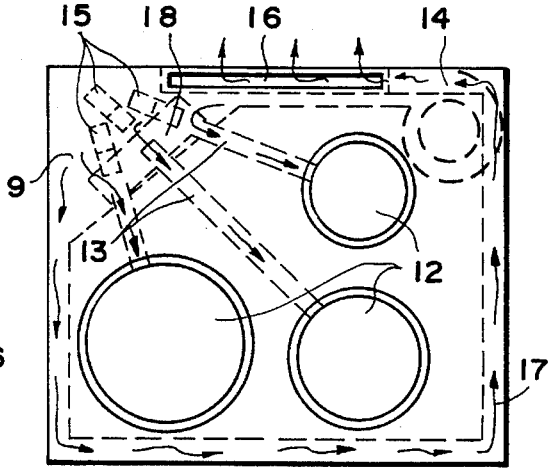
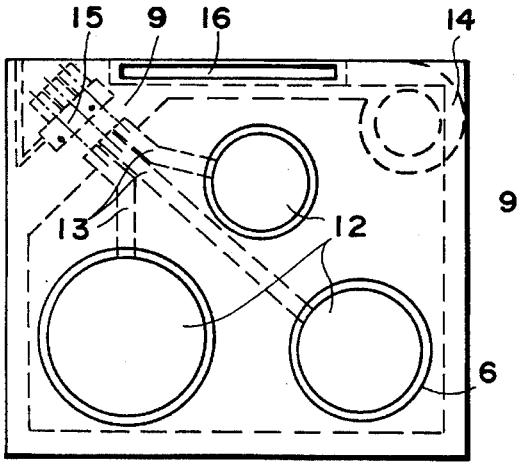
FIG. 3b
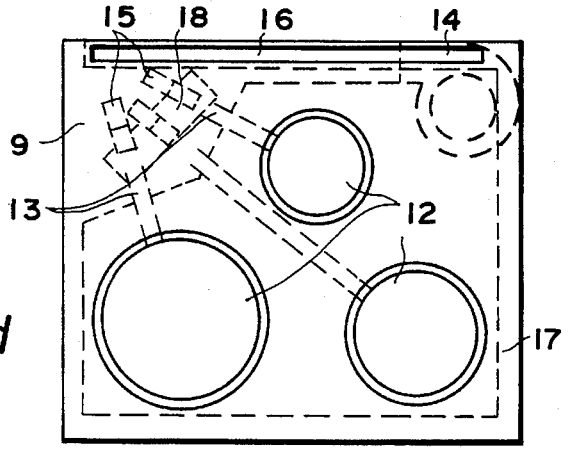
FIG. 3d

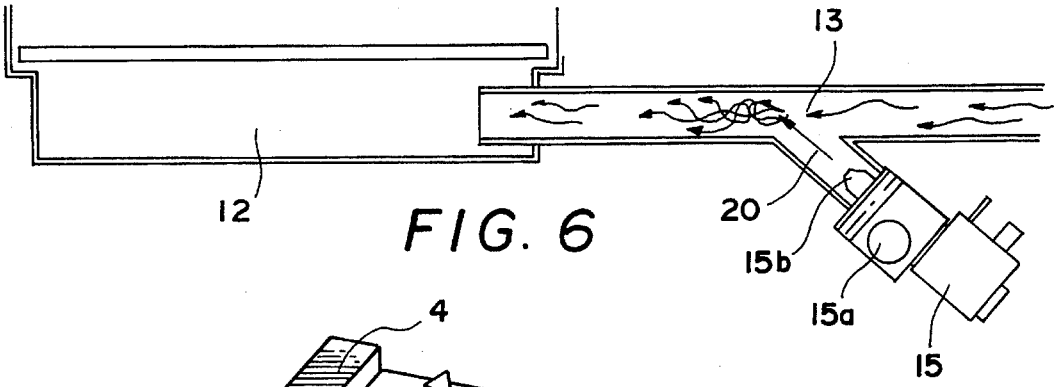
FIG. 6
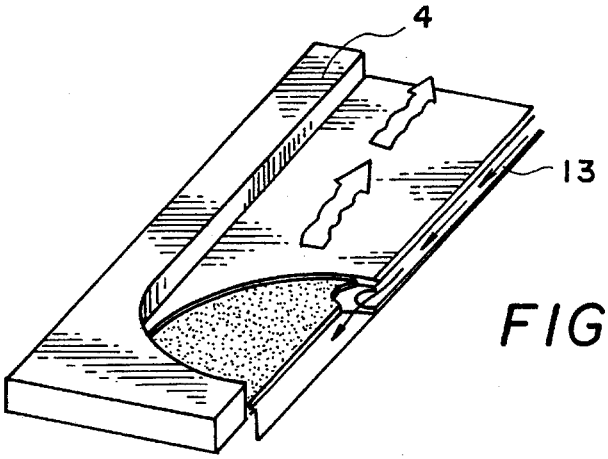
FIG. 7a
FIG. 7b
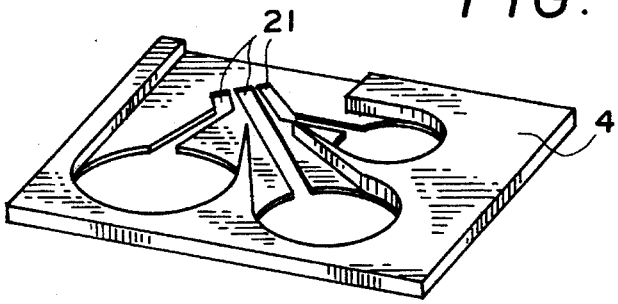
FIG. 8
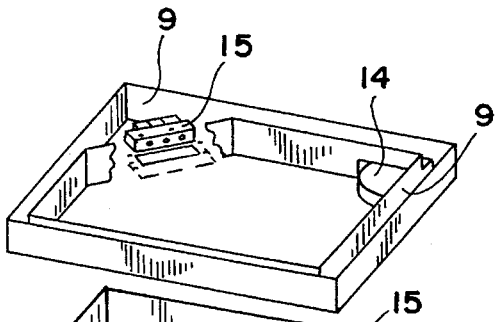
FIG. 9
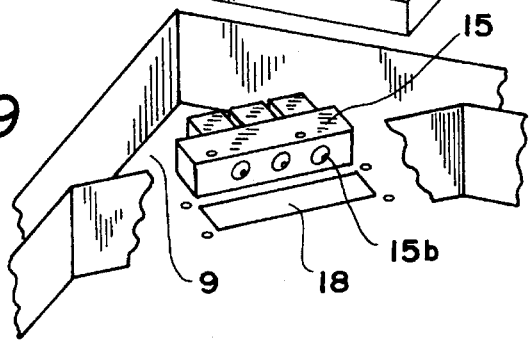

GAS FIRES COOKING ASSEMBLY WITH PLATE CONDUCTIVE TO HEAT RADIATION

FIELD OF THE INVENTION

The invention relates to a gas cooking assembly having at least one gas-fired burner mounted below a continuous cooking plate made of a material such as glass ceramic, glass or like material. The material of the cooking plate is conductive to heat radiation and the gas-fired burner includes a burner chamber and a burner plate made of a fiber material. The gas cooking unit further includes control units for metering the gas as well as conventional ignition, safety and temperature-monitoring units. The cooking assembly also includes exhaust-gas channels for conducting the combustion gases away as well as a device, such as a blower, for conveying additional air to the burner plate.

BACKGROUND OF THE INVENTION

Numerous embodiments of gas cooking assemblies equipped with gas-fired burners and a glass ceramic cook plate have been described, for example, in U.S. Pat. Nos. 3,468,298; 4,020,821; 4,083,355 and 4,201,184.

In gas-fired burners, the gas is combusted at the surface of a burner plate made of a porous ceramic. In a gas cooking assembly, one or more such gas-fired burners are mounted at a distance below a common glass ceramic plate known per se. A cooking position is defined by each burner at the upper side of the glass ceramic plate. Each individual gas-fired burner is secured by an ignition device and by a safety pilot against an unused away-flowing combustible gas mixture. The description of one such burner plate is presented, for example, in European patent publication 0,187,508.

The temperature of the radiating burner plate lies between approximately 900° C. and 950° C. depending upon the temperature resistance of the material. The maximum quantity of gas which call be metered to the burner is so limited by structural measures that a maximum operating temperature cannot be exceeded, for example, in order to protect the material of the burner plate or of the cooking plate and also to avoid unnecessary energy losses.

The permissible maximum temperature of glass ceramic cookplates lies usually between approximately 700° C. and 750° C. Temperatures of 900° C. and more can occur within a short time span in the glass ceramic plate for pots having unsuitable and especially uneven bottoms and for unoccupied cooking positions with power set at high. For this reason, a temperature limiter is provided to protect the glass ceramic plate, which limiter reliably prevents overtemperatures of this kind.

Such temperature limiters are described in detail, for example, in U.S. Pat. No. 4,201,184.

In addition to a temperature limiter, a control of the power of the burner must be provided for the practical utilization for heating a cooking area.

Two principles are known with respect to controlling the power. According to one principle, the burner is operated continuously and the metered quantity of gas is reduced or increased in response to the required power. According to the other principle, the burner is driven in a clocked manner, that is, the burner is always driven with the maximum quantity of gas and the required power results from the ratio of switch-on time to switch-off time (pulse-duty factor).

German patent publication 3,315,745 discloses a cooking field having gas-heated burners and a continuous cooking plate made of glass ceramic or a comparable material. The cooking field has at least two clearly separated cooking zones to which corresponding separate burner locations are assigned. The cooking area further has a warm-holding zone and exhaust-gas channels for conducting the combustion gases away as well as auxiliary devices. The burner locations include combustion chambers, gas-mixing chambers, gas-mixing units and control units. The burner locations, the warm-holding zone and the exhaust-gas channels are enclosed at the locations thereof, which do not serve to conduct heat to the cooking field and at all locations of the burners, by a component common to these parts and made of a low-mass and heat-insulating material.

German patent publication 3,315,745 also discloses that a jet plate can be alternately produced from silicate fiber material. In this connection, reference may be made to column 6, lines 21 and 22, of this publication.

German patent publication 3,844,081 discloses a cooking apparatus having at least one cooking field comprising a burner pot seated in a burner plate, a nozzle plate and a ceramic plate mounted above the nozzle plate and spaced relative thereto. An intermediate base is arranged below the burner pot and a space is formed below the intermediate base for control and/or monitoring apparatus. An exhaust channel is provided for conducting the exhaust gases away. An essentially vertical shaft is provided at the rearward end of the cooking apparatus and this shaft can be connected to an exhaust channel or be configured as such. A fan is provided in the space for the control and/or monitoring apparatus. The fan draws cooling air in primarily through this space from the front end and presses this cooling air into the shaft. The shaft is configured as a flow channel in such a manner that the primary cooling air draws secondary cooling air in via the space between the burner plate and the intermediate base and conducts away the exhaust gas emanating from the space between the burner plate and the ceramic plate.

German patent publication 3,844,081 has the task to improve a cooking apparatus of the kind described with respect to the control of waste heat and to thereby improve the apparatus with respect to overall thermal design. A fan is utilized in order to remove only the exhaust gas with a relatively considerable complexity in structure.

U.S. Pat. No. 4,020,821 discloses positioning a blower in a gas cooking apparatus having a continuous plate, for example, made of glass ceramic. The blower brings in additional air for obtaining a good combustion of the gas. However, no gas-fired burners having burner plates are utilized; instead, burners with an open flame are utilized.

British patent publication 2,230,595 discloses a gas range having a glass ceramic plate and at least one gas-fired burner mounted closely beneath the plate. Each burner has a burner chamber with a high number of individual chambers. A burner plate of ceramic is mounted over the burner chamber and is perforated in correspondence to the arrangement of the chambers. Furthermore, the gas range has a gas supply and a fan device to always make combustion air available when the burner operates.

U.S. Pat. No. 4,020,821 as well as British patent publication 2,230,595 disclose the use of fans or blowers in gas cooking apparatus having continuous glass ceramic cooking plates. However, the overall arrangement of the cooking devices is very complicated and complex and therefore unreliable in practical use and expensive to produce.

SUMMARY OF THE INVENTION

In view of the foregoing, it is an object of the invention to provide a gas cooking assembly with a new kind of gas burner technology which can use various gas types such as natural gas or liquid gas, such as propane or butane. This gas cooking assembly has a very high component of radiation energy at very low waste gas values, guarantees a rapid response to changes of burner energy over a large control range and guarantees the greatest possible safety with a simple configuration and a low overall height.

It is a further object of the invention to provide a gas cooking assembly which combines the advantages of the gas flame with the advantages of easy cleaning and the pleasing appearance of a glass ceramic cooking surface and which can be produced cost effectively. It is still another object of the invention to provide a gas cooking assembly having a minimum of expensive heat-attenuating materials which are difficult to dispose of in an environmentally safe manner. Still a further object of the invention is to provide such a gas cooking assembly which requires a minimum of effort in maintenance and repairs especially because all components are mounted so that they are neatly arranged and are easily accessible.

The object of the invention is realized in that the arrangement, which, in addition, draws in air from the ambient and guides the air to the burner plate, is mounted together with the control unit for the metering of gas in a partitioned-off space in which an overpressure is maintained. The space communicates via conduits such as pipes with the burner chamber and with the ambient. The conduits are gas tight at their peripheral surfaces in the region outside of the partitioned-off space.

The control unit for metering gas includes a valve block having exchangeable nozzles positioned in the block. The nozzles have opening diameters of 0.5 mm to 2.0 mm, especially with an opening diameter of 1 mm. The nozzles can be exchanged in dependence upon the type of gas.

The control can be mechanical, pneumatic or hydraulic when this is advantageous for a particular case. The valve block is usually so configured that the nozzles are arranged one next to the other and that their respective gas jets are emitted parallel to one another. The valve block can, however, also be so configured that the gas jets are emitted at an angle to each other.

If it should be necessary for reasons of space, a valve block of, for example, four nozzles can be subdivided without difficulty into units with, for example, two units with two nozzles each or one unit with two nozzles and two units with one nozzle each. This is especially then recommended when, in this way, the conduits conducting the gas/air mixture can remain straight in the arrangement of the component groups.

In the partitioned-off space, an overpressure of at least 0.1 mbar is maintained with the device with which additional air is brought to the burner plate, that is, especially by a blower. The gas-tight conduits connect the partitioned-off space to the burner chambers and can have different inlet cross-sectional areas. Thus, they can be configured to be round, oval or rectangular in the through-flow regions in order to augment the gas/air mixture and the venturi effect.

The center of the inlet openings of a conduit, which connects the partitioned-off space to the burner chamber, is arranged in each case opposite a nozzle opening at a spacing which can be variably adjusted. The spacing between the beginning of the pipe and the nozzle openings is adjustable in order to adapt individually to burners of different size and/or different power.

In an especially preferred embodiment, the conduit, which conducts the gas/air mixture, is provided with breakthroughs in the form of inlet openings for the air. These inlet openings in the conduit are provided in the region of the partitioned-off space in which the overpressure is maintained. The breakthroughs are arranged especially radially and are adaptable. The conduit can then begin directly at the valve block or in the plane of the nozzle opening. In this way, defined assembly relationships and a constant metering of air volume are guaranteed.

Advantageously, the inlet openings for the air are enlarged or made smaller, for example, by means of an annular collar movable on a thread of the conduit or by means of displaceable diaphragms. In this way, the inlet openings can be adapted precisely and without effort to the air requirement of the particular burner type or the particular burner size. In this embodiment, the conduits then act over their entire lengths as mixing pipes with the air inflow into the pipes being achieved by the overpressure and the venturi effect occurring as a consequence of the gas injected by the nozzles.

The gas flow is injected into the openings of the mixing pipes and entrains the necessary combustion air. Advantageously, the inlet cross-sectional area of the conduit for metering the gas/air mixture is more than 150 $mm^2$.

According to another embodiment of the invention, the valve block, as part of the control device for metering gas, is so mounted in the partitioned-off space that the block, by means of its nozzles positioned in the block, injects the gas laterally at an angle of less than 90° into openings which are provided in the conduit. Here, the gas is metered by a lateral injection and ensures that the gas in this way impinges on the opposite-lying pipe wall for turbulence and so provides for an excellent premixing of the gas/air mixture.

In a preferred embodiment, the control device, especially the valve block, is accessible via a tightly closeable service opening in order to carry out repairs without difficulty or to facilitate a rapid assembly or disassembly of the gas nozzles.

A further advantage of the invention is that the device with which the additional air is brought to the burner plate is so positioned in the partitioned-off space that this device cools especially the control device but also other heat-sensitive control devices by the air emitted from this device. In addition, the blower can be so positioned in the gas cooking assembly that the primary cooling air drawn in by the blower first must pass control devices below the blower before the primary cooling air reaches the blower.

In a further advantageous embodiment, the blower, which maintains an overpressure in the partitioned-off chamber, cools via a bypass the exhaust gases, which are generated by the combustion, by admixing air. The exhaust-gas temperatures at the outlet of the cooking assembly are markedly reduced by this blower arrangement. The operational reliability of the cooking assembly and the user comfort are thereby improved.

According to the invention, the blower can additionally cool the housing wall via an air-conducting system installed in the outer walls of the cooking assembly. This likewise again leads to an increase in the operational reliability and user comfort. In some cases, it can also be advantageous to divert a portion of the air flow generated by the blower under the burner chamber so that it impinges on the hot lower side of the cooking zone. In this way, the temperature of the upper side of the glass ceramic plate can be influenced and a rapid cool-off of the hot regions of the plate is possible especially after switching off the burners.

According to the invention, it is also possible that the gas/air mixture, which is brought by the conduits to the burner plate, is so guided that it is preheated by the hot exhaust gases. These measures lead especially to improved degrees of efficiency and therefore also to a saving of energy.

In a preferred embodiment of the invention, the burner plate includes especially SiC fibers as a fiber material.

This burner type has many advantages. Thus, if a combustible gas/air mixture containing liquid gas or natural gas flows through the porous fiber burner plate and is ignited at the upper side of the burner material, then the material glows red within one second because of the low thermal mass.

The hot burner surface radiates the primary portion of the energy at infrared wavelengths. The energy reaches the base of the pot by radiation and conduction through the glass ceramic plate.

The requirements as to safety and practicality as to use of such systems are fixed in the European standard EN 30 entitled "Haushaltskochgeräte für gasförmige Brennstoffe". One of the criteria is the start-to-boil efficiency. Start-to-boil efficiencies of 37% are reached with the gas cooking assembly according to the invention. This efficiency lies 44% higher than the limit values fixed by the European standard EN 30.

In addition, emissions of $NO_x$ and CO were measured on the gas cooking assembly according to the invention. The emissions for $NO_x$ and CO are below the lower limit values of 37 ppm for $NO_x$ and 54 ppm for CO (criteria for the "Blauen Engel").

The burner plates of SiC fibers are furthermore also less harmful to the environment since the raw materials are present in large quantities in nature. The composite material formed from these fibers resists oxidation even at high temperatures. Service life cycle tests of over 5,000 hours were carried out without any deterioration of the burner characteristics with the fiber burner according to the invention. The burner was started 12,000 times even under strict combustion conditions without a change of the material being determined.

Furthermore, endangerment to persons by the silicon carbide fibers is not known to date.

BRIEF DESCRIPTION OF THE DRAWINGS

The invention will now be described with reference to the drawings wherein:

FIGS. 1*a* to 1*f*, taken together, show a gas cooking assembly according to the invention with its essential components depicted in a perspective exploded view;

FIG. 2*a* shows an insulating molded body having a geometry for the exhaust-gas lines different from that shown in FIG. 1*b;*

FIG. 2*b* shows another embodiment of the insulating molded body having another geometry for the exhaust-gas lines;

FIG. 3*a* is a schematic plan view of a gas cooking assembly according to the invention with a first configuration of the conduits leading to the burner chambers;

FIG. 3*b* is a schematic of a gas cooking assembly with a somewhat different configuration of the conduits leading to the burner chambers;

FIG. 3*c* is a plan view of a gas cooking assembly with another configuration of the conduits leading to the burner chambers and wherein the control units are defined as individual elements;

FIG. 3*d* is a schematic plan view of a gas cooking assembly wherein the control units are also defined as individual elements;

FIG. 6 shows an embodiment of the gas cooking assembly of the invention wherein the gas is injected laterally into the conduits leading to the burner chambers;

FIG. 7*a* is a perspective view showing how the gas/air mixture flowing in the mixing pipe can be preheated by hot exhaust gas;

FIG. 7*b* shows cutouts formed in the insulating molded body to facilitate a thermal exchange between outflowing hot exhaust gases and incoming gas/air mixture;

FIG. 8 is a perspective view showing how the blower can be mounted in the housing of the gas cooking assembly;

FIG. 9 shows the position of the recloseable service opening vis-a-vis the gas nozzles of the control unit; and, FIG. 10 is a graph showing various parameters of the gas cooking assembly of the invention.

DESCRIPTION OF THE PREFERRED EMBODIMENTS OF THE INVENTION

Figure 4:
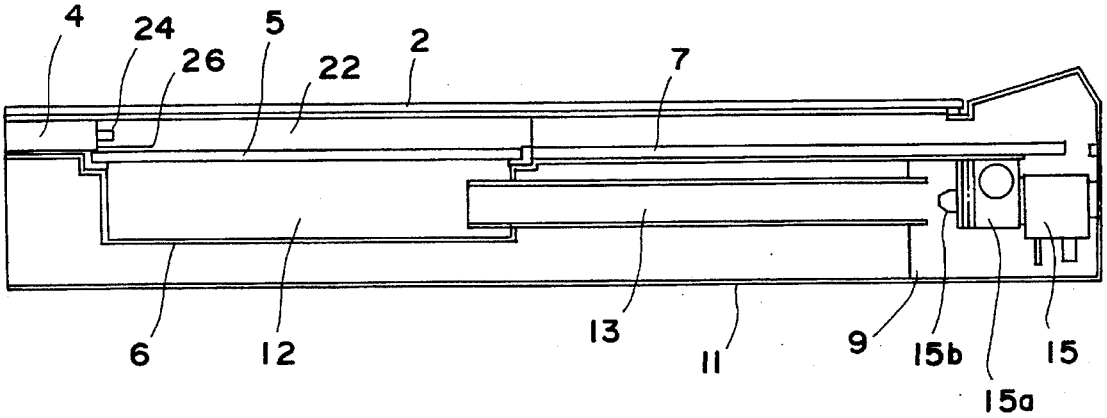
FIG. 4 is a section view of a gas cooking assembly of the invention.

FIG. 1*a* shows a cooking field frame 1 having a built-in glass ceramic top plate 2 and an exhaust-gas port 3.

FIG. 1*b* shows an insulating molded body 4 having cutouts 4*a* for the burners and a cutout 4*b* for the exhaust-gas lines.

FIG. 1*c* shows burner plates 5 made of fiber material which are cemented gas tight into the burner chambers.

FIG. 1*d* shows a mounting plate 7 for the burners 7*a* and the control unit 7*b* and a cutout 7*c* for the bypass slit.

FIG. 1*e* shows a double-wall housing 8 having the partitioned-off space 9 and an air-channel system 10 for cooling the housing.

FIG. 1*f* shows the base plate 11 having a cutout 11*a* for the blower intake and the service opening 11*b*.

FIGS. 2*a* and 2*b* introduce, in perspective view, types of insulating molded bodies 4 having geometries, which are different from those of FIG. 1*b*, with cutouts 4*a* for the burners and cutouts 4*b* for the exhaust-gas lines. The insulating molded bodies are, for example, made of vermiculite.

FIG. 3*a* is a schematic showing a gas cooking assembly according to the invention in plan view when the cooking field frame with the continuous glass-ceramic plate is removed.

Three gas-fired burners 12 can be seen which are connected to the partitioned-off space 9 via gas-tight lines 13 which are here formed as smooth mixing pipes. The blower 14 and a portion of the control unit 15 are located in the partitioned-off space 9. The blower 14 generates an overpressure of 0.5 mbar and the portion of the control unit 15 here is a three-valve block 15*a* having magnetic control and having gas nozzles 15*b* (see FIG. 4) for natural gas threadably engaged therewith.

The blower 14 brings in ambient air to the burners 12 and additionally cools the exhaust gases generated during combustion via a bypass 16. The blower further prevents increased temperatures at the housing wall by means of an air-conducting system 17 provided at the outer walls of the cooking assembly.

The control unit 15 is always accessible via a recloseable service opening 18 in order that the nozzles can be exchanged or so that service work can be performed.

FIG. 3*a* furthermore shows the conduction of the gas flows in the cooking assembly. Here it can be seen that the control unit 15 is cooled by the air flow of the blower 14.

FIG. 3*b* shows a modified arrangement of three gas jet burners 12 and, as shown in FIG. 3*a*, the center of the inlet opening of the mixing pipe 13 is provided with a spacing which is variable with respect to the burners. The mixing pipe 13 connects the partitioned-off space 9, which is at overpressure, to the combustion chamber 6. The service opening is here not shown in order to provide a better overview.

In contrast to FIGS. 3*a* and 3*b*, FIG. 3*c* shows a control unit 15 having respective gas nozzles threadably engaged. In the control unit 15, the valve block is subdivided into three individual elements. In this way, the mixing pipes 13 can be configured so as to be straight. The mixing pipes 13 supply the gas-fired burners 12 with the gas/air mixture.

In comparison to FIGS. 3*a* to 3*c*, FIG. 3*d* shows another arrangement of the burners 12 and the control units 15, here also defined as individual elements.

FIG. 4 shows a section through the gas cooking assembly of the invention. The gas nozzle 15*b* has an opening diameter of 1.0 mm. Via this gas nozzle 15*b* of the magnetically controlled control unit 15 having the valve block 15*a*, the gas is injected into the mixing pipe 13 at a pressure of 30 mbar. The gas injected is a conventional propane/butane mixture. The partitioned-off space 9 is at an overpressure of 0.2 mbar because of the blower (not shown). The blower draws in air from the ambient. Because of the overpressure and the so-called venturi effect, the air likewise reaches the mixing pipe 13 and is there swirled and mixed thoroughly with the gas before the mixture reaches the burner 12. The burner 12, in accordance with the invention, is built up of a burner plate 5 of fiber material, which contains SiC fibers, and a burner chamber 6.

FIG. 4 also shows a glass-ceramic plate 2 defining a cooking surface as it is commercially available (for example, under the trademark CERAN of Schott Glaswerke of Mainz, Germany) and the arrangement, on the one hand, of the mounting plate 7 for the burners and the control unit and, on the other hand, of the insulating molded body 4. The burner plate 5 is made of porous fiber material such as silicon carbide and is porous to the gas/air mixture flowing out of outlet opening 13*a* of mixing pipe 13. The plate 2 and the burner plate 5 conjointly define a gap 22 therebetween. The gas/air mixture passes through the plate 5 into the gap 22 where the gas/air mixture is ignited by an electrically energizable ignition device 24 such as a hot surface igniter, spark ignition or the like mounted in a side wall 26 of the cutout formed in the insulating molded body 4. Ignition devices of the kind identified by reference numeral 24 are well known and are shown, for example, in U.S. Pat. No. 4,201,184 incorporated herein by reference.

Figure 5A:
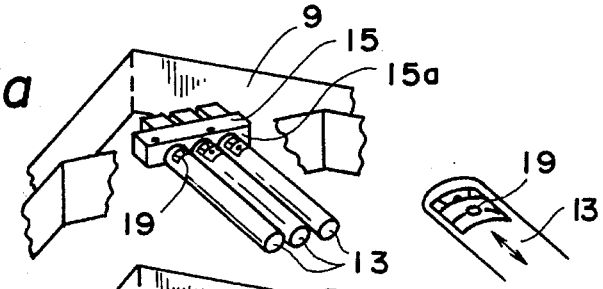
FIG. 5*a* is a perspective view showing how the gas/air mixture can be adjusted by displaceable diaphragms in the conduit pipes leading to the burner chambers.

FIG. 5*a* shows a possibility as to how the gas/air mixture can be adjusted in accordance with the invention, namely, via displaceable diaphragms 19 which make the openings of the breakthroughs in the mixing pipe 13 variable. These openings function as inlet openings for the air of the gas/air mixture. The diaphragms 19 are mounted in that region of the mixing pipes 13, which is disposed in the partitioned-off space 9. The mixing pipes 13 are here oval.

The mixing pipes 13 can therefore begin directly at the valve block 15*a* of the control unit 15.

Figure 5B:
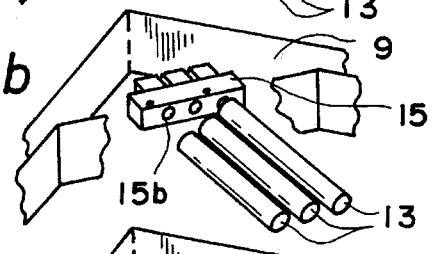
FIG. 5*b* is another configuration showing how the gas/air mixture can be adjusted with variably adjusted spacing between the nozzles and respective mixing pipes.
Figure 5C:
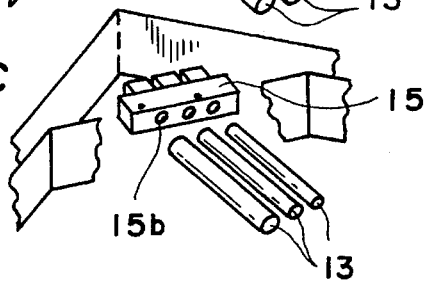
FIG. 5*c* shows still another configuration for adjusting the gas/air mixture wherein the conduits are provided with respectively different cross sections.

FIG. 5*b* shows a further possibility to adjust the gas/air mixture with the aid of the variably adjustable spacing between the nozzle 15*b* and mixing pipe 13; whereas, FIG. 5*c* shows the possibility of adjusting via different cross sections of the mixing pipes 13.

The configurations shown in FIGS. 5*a* to 5*c* for adjusting the air of the gas/air mixture supplied to the burners are set and fixed at the factory during manufacture of the gas cooking assembly.

FIG. 6 shows a variation of the invention according to which gas is injected laterally. The control unit 15 is then so mounted for metering gas that the unit injects the gas laterally via its nozzles 15*b* positioned in the valve block 15*a*. The gas is injected at an angle of approximately 40° into the openings 20 which are provided in the mixing pipe 13 which here initially only conducts the incoming air.

The gas/air mixture then enters the burner 12 thoroughly mixed because of the turbulences triggered on the pipe wall.

FIG. 7*a* shows how the gas/air mixture flowing in the mixing pipe 13 is preheated by the hot exhaust gas, which is generated by the combustion, when the insulating molded body 4 is suitably configured as shown with greater clarity in FIG. 7*b*. In FIG. 7*b*, the molded body 4 is shown having cutouts 21 which facilitate a heat exchange between the mixing pipes 13 and the outflowing hot exhaust gas.

Several essential features of the invention are again shown in a perspective view in FIG. 8. The blower 14 and the control unit 15 are mounted in a partitioned-off space 9 in which an overpressure is maintained. The blower 14 draws in air from the ambient and the control unit 15 is provided for the metered gas.

FIG. 9 shows the position of the recloseable service opening 18 for quickly exchanging the gas nozzles 15*b* of the control unit 15.

Figure 10:
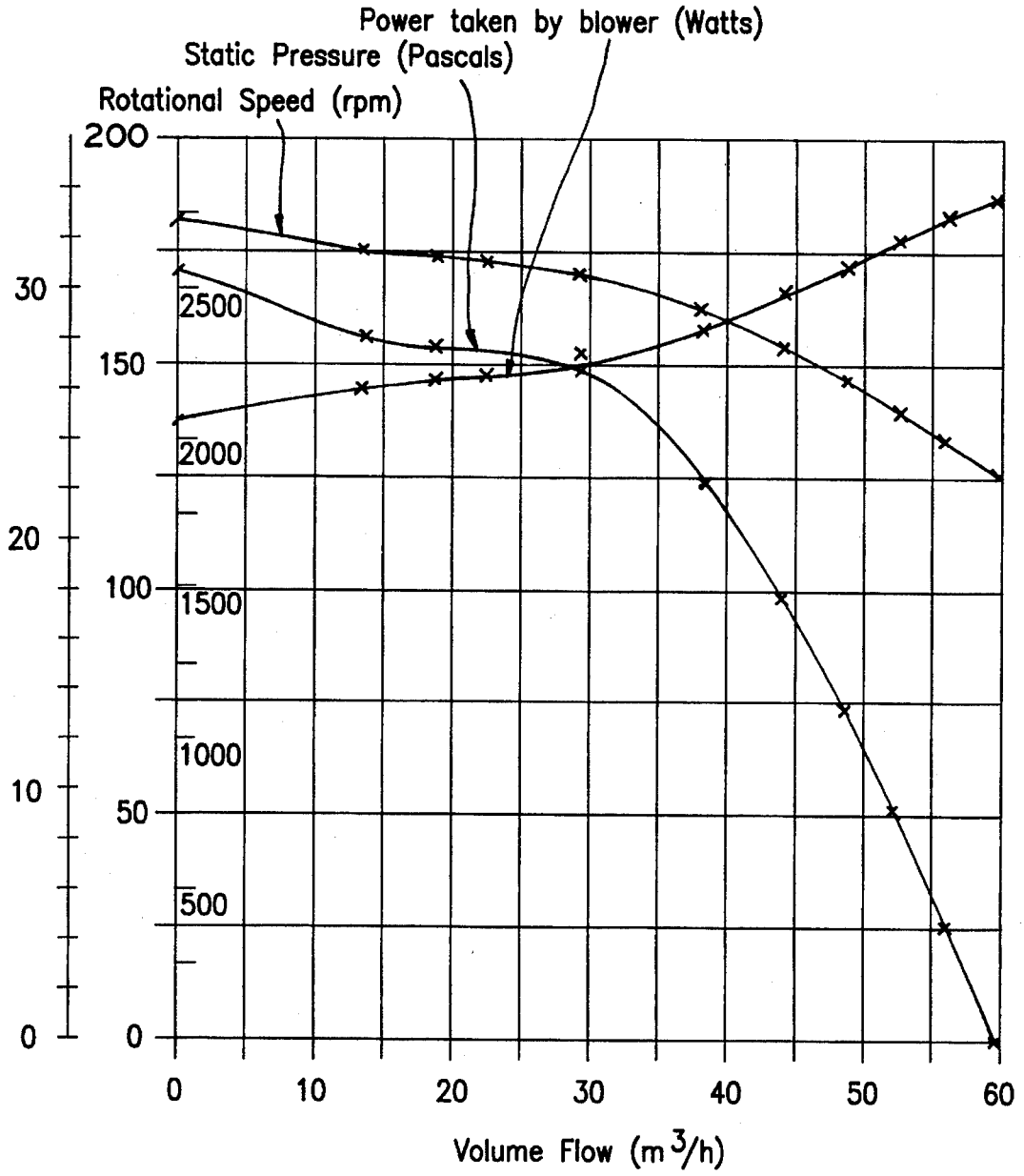

FIG. 10 shows the dependency of the volume flow ($m^3/h$) on the rotational speed (rpm), power (watts) and static pressure (pascals) of the blower used.

With the optimal configuration of the system, a matched dimensioning of the blower parameters and the venturi effect leads to an improved control performance of the burners. Possible pressure fluctuations in the gas supply network and the changes in the gas/air mixture resulting therefrom can be leveled with a suitable configuration (required by EN 30).

That is, when the gas pressure increases above the conventional operating pressure, then this leads to a static pressure in the partitioned-off space 9 which is lower in relationship to the usual operating pressure. The increase in gas pressure is caused by the then amplified venturi effect. Accordingly, the rpm of the blower becomes less and the volume flow moved thereby becomes greater. The ratio of gas to air remains essentially constant.

If the gas pressure drops below the usual operating pressure, this leads to a weaker venturi effect and thereby, in comparison to the conventional operating pressure, to a greater static pressure in the partitioned-off space. The rpm of the blower becomes greater and therefore the moved volume flow becomes less. The gas/air mixture remains within tolerable limits. In both cases, the combustion quality (CO, $NO_x$) remains in a favorable range.

The advantages of the present invention are:

(a) a higher proportion of radiation energy;

(b) low exhaust-gas values;

(c) rapid and visually detectable response to changes of burner output;

(d) large control range;

(e) the burner chamber and the burner chamber periphery remain relatively cool (approximately 50° C.) notwithstanding the high surface temperature (>800° C.) of the fiber burner plate;

(f) uniformly bright glowing image because of the high degree of emission (95%) of SiC;

(g) simple, compact and economic configuration at low overall height of the structure (approximately 80 mm);

(h) neat arrangement of all components;

(i) easy maintenance and repair;

(j) one blower/fan for: the forced ventilation of all burners and for the various cooling tasks;

(k) the control unit of the burners is easily accessible at all times;

(l) exchangeable gas nozzles for various types of gas;

(m) simple combustion chamber geometry;

(n) improved efficiency;

(o) longer service life of the electronic units because of the cooling; and, (p) possibility to operate without additional gas lines and therefore higher safety because of a reduction of gas-conducting components.

It is understood that the foregoing description is that of the preferred embodiments of the invention and that various changes and modifications may be made thereto without departing from the spirit and scope of the invention as defined in the appended claims.

What is claimed is:

1. A gas cooking assembly comprising:

a housing having first and second spaces formed therein and said first space being partitioned off from said second space;

a cover plate mounted atop said housing to define a continuous cooking surface;

said cover plate being made of a material conductive to heat radiation and having a lower surface facing away from said cooking surface;

at least one gas-fired burner mounted in said second space below said plate;

said gas-fired burner including a burner chamber and a porous burner plate mounted in said burner chamber;

said lower surface of said cover plate and said burner plate conjointly defining a gap therebetween;

blower means mounted in said first space for introducing air from the ambient into said first space and for maintaining said first space at a predetermined overpressure of at least 0.1 mbar;

a conduit communicating with said burner chamber and extending from said burner chamber into said first space;

said conduit having a gas-tight peripheral surface within said second space and having an inlet opening means in said first space;

a control unit for metering gas;

said control unit being mounted in said first space whereby said control unit is cooled by said air introduced into said first space by said blower means;

said control unit including valve block means having an exchangeable nozzle for injecting a jet of said gas into inlet opening means of said conduit thereby entraining air present in said first space to form a gas/air mixture which travels along said conduit and into said burner chamber and upwardly through said porous burner plate into said gap;

ignition means mounted in said gap for igniting said gas/air mixture to generate said heat radiation whereby exhaust gases are produced; and, exhaust-gas channel means arranged in said housing for conducting said exhaust gases away from said gap.

2. The gas cooking assembly of claim 1, said nozzle having an opening diameter in the range of 0.5 mm to 2.0 mm and being adaptable for different types of gas.

3. The gas cooking assembly of claim 2, said diameter being 1.0 mm.

4. The gas cooking assembly of claim 2, further comprising: a plurality of said gas-fired burners and a corresponding plurality of said conduits; and, each of said conduits having a cross-sectional area configured to be circular, oval or rectangular.

5. The gas cooking assembly of claim 2, said conduit having a cross-sectional area of at least 150 $mm^2$.

6. The gas cooking assembly of claim 2, said conduit having a tubular wall defining a longitudinal axis and having a portion thereof disposed in said first space; said inlet opening means including a first opening formed in said tubular wall of said first portion of said conduit and a second opening formed in said first portion for admitting air from said first space; and, said valve block means being mounted in said first space so as to cause said nozzle thereof to inject said jet of said gas into said first opening at an angle less than 90° to said axis.

7. The gas cooking assembly of the claim 2, said housing having an outer peripheral side wall; and, said blower means including a blower and a channel formed along said side wall for conducting cooling air therealong.

8. The gas cooking assembly of the claim 2, said conduit being mounted so as to be in close proximity to said exhaust-gas channel means whereby a thermal, exchange occurs which preheats said gas/air mixture before reaching said burner chamber.

9. The gas cooking assembly of the claim 2, said burner plate being made of fiber material.

10. The gas cooking assembly of the claim 9, said fiber material being silicon carbide fibers.

11. A gas cooking assembly comprising:

a housing having first and second spaces formed therein and said first space being partitioned off from said second space;

a cover plate mounted atop said housing to define a continuous cooking surface;

said cover plate being made of a material conductive to heat radiation and having a lower surface facing away from said cooking surface;

at least one gas-fired burner mounted in said second space below said plate;

said gas-fired burner including a burner chamber and a porous burner plate mounted in said burner chamber;

said lower surface of said cover plate and said burner plate conjointly defining a gap therebetween;

a blower mounted in said first space for introducing air from the ambient into said first space and for maintaining said first space at a predetermined overpressure;

a conduit communicating with said burner chamber and extending from said burner chamber into said first space;

said conduit having a gas-tight peripheral surface within said second space and having an inlet opening means in said first space;

a control unit for metering gas;

said control unit being mounted in said first space whereby said control unit is cooled by said air introduced into said first space by said blower means;

said control unit including valve block means having a nozzle for injecting a jet of said gas into inlet opening means of said conduit thereby entraining air present in said first space to form a gas/air mixture which travels along said conduit and into said burner chamber and upwardly through said porous burner plate into said gap;

an ignition device mounted in said gap for igniting said gas/air mixture to generate said heat radiation whereby exhaust gases are produced;

an exhaust-gas channel arranged in said housing for conducting said exhaust gases away from said gap; and, said conduit being mounted so as to be in close proximity to said exhaust-gas channel whereby a thermal exchange occurs which preheats said gas/air mixture before reaching said burner chamber.

12. A gas cooking assembly comprising:

a housing having first and second spaces formed therein and said first space being partitioned off from said second space;

a cover plate mounted atop said to define a continuous cooking surface;

said cover plate being made of a material conductive to heat radiation and having a lower surface facing away from said cooking surface;

at least one gas-fired burner mounted in said second space below said plate;

said gas-fired burner including a burner chamber and a porous burner plate mounted in said burner chamber;

said lower surface of said cover plate and said burner plate conjointly defining a gap therebetween;

blower means mounted in said first space for introducing air from the ambient into said first space and for maintaining said first space at a predetermined overpressure;

a conduit communicating with said burner chamber and extending from said burner chamber into said first space;

said conduit having gas-tight peripheral surface within said second space and having an inlet opening means in said first space;

a control unit for metering gas;

said control unit being mounted in said first space whereby said control unit is cooled by said air introduced into said first space by said blower means;

said control unit including valve block means having a nozzle for injecting a jet of said gas into inlet opening means of said conduit thereby entraining air present in said first space to form a gas/air mixture which travels along said conduit and into said burner chamber and upwardly through said porous burner plate into said gap;

ignition means mounted in said gap for igniting said gas/air mixture to generate said heat radiation whereby exhaust gases are produced;

exhaust-gas channel means arranged in said housing for conducting said exhaust gases away from said gap;

said nozzle being exchangeable and having an opening diameter in the range of 0.5 mm to 2.0 mm and being adaptable for different types of gas;

a plurality of said gas-fired burners and a corresponding plurality of said conduits;

said valve block means having a plurality of nozzles for corresponding ones of said conduits;

said nozzles having respective nozzle openings;

said inlet opening means of each of said conduits having a center; and, said conduits being arranged in said housing so as to cause the center of said conduits to be at respectively different distances from said nozzle openings.

13. A gas cooking assembly comprising:

a housing having first and second spaces formed therein and said first space being partitioned off from said second space;

a cover plate mounted atop said housing to define a continuous cooking surface;

said cover plate being made of a material conductive to heat radiation and having a lower surface facing away from said cooking surface;

at least one gas-fired burner mounted in said second space below said plate;

said gas-fired burner including a burner chamber and a porous burner plate mounted in said burner chamber;

said lower surface of said cover plate and said burner plate conjointly defining a gap therebetween;

blower means mounted in said first space for introducing air from the ambient into said first space and for maintaining said first space at a predetermined overpressure;

a conduit communicating with said burner chamber and extending from said burner chamber into said first space;

said conduit having gas-tight peripheral surface within said second space and having, an inlet opening means in said first space;

a control unit for metering gas;

said control unit being mounted in said first space whereby said control unit is cooled by said air introduced into said first space by said blower means;

said control unit including valve block means having a nozzle for injecting a jet of said gas into inlet opening means of said conduit thereby entraining air present in said first space to form a gas/air mixture which travels along said conduit and into said burner chamber and upwardly through said porous burner plate into said gap;

ignition means mounted in said gap for igniting said gas/air mixture to generate said heat radiation whereby exhaust gases are produced;

exhaust-gas channel means arranged in said housing for conducting said exhaust gases away from said gap;

said nozzle being exchangeable and having an opening diameter in the range of 0.5 mm to 2.0 mm and being adaptable for different types of gas;

a plurality of said gas-fired burners and a corresponding plurality of said conduits;

said valve block means having a plurality of nozzles for corresponding ones of said conduits;

said nozzles having respective nozzle openings;

said conduits extending into said first space up to said valve block means so as to place said inlet opening means directly at the nozzle corresponding thereto;

each of said conduits having a wall and a portion of said wall being in said first space; and, breakthrough means formed in said first portion of said wall for permitting the jet of gas to entrain air from said first space passing through said breakthrough means,

14. A gas cooking assembly comprising:

a housing having first and second spaces formed therein and said first space being partitioned off from said second space;

a cover plate mounted atop said housing to define a continuous cooking surface;

said cover plate being made of a material conductive to heat radiation and having a lower surface facing away from said cooking surface;

at least one gas-fired burner mounted in said second space below said plate;

said gas-fired burner including a burner chamber and a porous burner plate mounted in said burner chamber;

said lower surface of said cover plate and said burner plate conjointly defining gap therebetween;

blower means mounted in said first space for introducing air from the ambient into said first space and for maintaining said first space at a predetermined overpressure;

a conduit communicating with said burner chamber and extending from said burner chamber into said first space;

said conduit having gas-tight peripheral surface within said second space and having an inlet opening means in said first space;

a control unit for metering gas;

said control unit being mounted in said first space whereby said control unit is cooled by said air introduced into said first space by said blower means;

said control unit including valve block means having a nozzle for injecting a jet of said gas into inlet opening means of said conduit thereby entraining air present in said first space to form a gas/air mixture which travels along said conduit and into said burner chamber and upwardly through said porous burner plate into said gap;

ignition means mounted in said gap for igniting said gas/air mixture to generate said heat radiation whereby exhaust gases are produced;

exhaust-gas channel means arranged in said housing for conducting said exhaust gases away from said gap;

said nozzle being exchangeable and having an opening diameter in the range of 0.5 mm to 2.0 mm and being adaptable for different types of gas;

a plurality of said gas-fired burners and a corresponding plurality of said conduits;

said valve block means having a plurality of nozzles for corresponding ones of said conduits;

said nozzles having respective nozzle openings; and, said conduits being mounted in said housing so as to place the inlet opening means of each conduit opposite a corresponding one of said nozzles to produce a venturi effect as a consequence of the injected jet of gas whereby said conduits each define a mixing pipe because of the air under overpressure in said first space and said venturi effect.

* * * * *

UNITED STATES PATENT AND TRADEMARK OFFICE

CERTIFICATE OF CORRECTION

PATENT NO. : 5,509,403

DATED : April 23, 1996

INVENTOR(S) : Michael Kahlke and Kurt Schaupert

It is certified that error appears in the above-indentified patent and that said Letters Patent is hereby corrected as shown below:

On the title page, in the title: delete "FIRES" and substitute -- FIRED -- therefor.

On the title page, under OTHER PUBLICATIONS: delete "hushalt-Kochgeräte" and substitute -- Haushalt-Kochgeräte -- therefor.

In column 1, line 1: delete "FIRES" and substitute -- FIRED -- therefor.

In column 1, line 40: delete "call" and substitute -- can -- therefor.

In column 10, line 38: delete "thermal," and substitute -- thermal -- therefor.

In column 11, line 28: between "said" and "to", insert -- housing --.

In column 12, line 37: between "having" and "gas-tight", insert -- a --.

In column 12, line 38: delete "having," and substitute -- having -- therefor.

In column 13, line 5: delete "means," and substitute -- means. -- therefor.

UNITED STATES PATENT AND TRADEMARK OFFICE

CERTIFICATE OF CORRECTION

PATENT NO. : 5,509,403 Page 2 of 2

DATED : April 23, 1996

INVENTOR(S) : Michael Kahlke and Kurt Schaupert

It is certified that error appears in the above-indentified patent and that said Letters Patent is hereby corrected as shown below:

In column 13, line 21: between "defining" and "gap", insert -- a --.

In column 13, line 30: between "having" and "gas-tight", insert -- a --.

Signed and Sealed this

Thirtieth Day of July, 1996

Bruce Lehman

*Attest:*

BRUCE LEHMAN

*Attesting Officer*

*Commissioner of Patents and Trademarks*